US006955579B2

(12) United States Patent
Hecker et al.

(10) Patent No.: US 6,955,579 B2
(45) Date of Patent: Oct. 18, 2005

(54) MONOLITHIC SEAL FOR A SAPPHIRE METAL HALIDE LAMP

(75) Inventors: Arlene Hecker, Beverly, MA (US); George C. Wei, Weston, MA (US); Helmar G. Adler, Danvers, MA (US); Dieter Lang, Bruckmuehl (DE)

(73) Assignee: Osram Sylvania Inc., Danvers, MA (US)

( * ) Notice: Subject to any disclaimer, the term of this patent is extended or adjusted under 35 U.S.C. 154(b) by 11 days.

(21) Appl. No.: 10/805,372

(22) Filed: Mar. 19, 2004

(65) Prior Publication Data

US 2004/0185741 A1 Sep. 23, 2004

Related U.S. Application Data

(62) Division of application No. 09/952,982, filed on Sep. 14, 2001, now Pat. No. 6,873,108.

(51) Int. Cl.[7] ..... H01J 9/00

(52) U.S. Cl. ..... 445/27; 445/26

(58) Field of Search ..... 445/22, 26, 27

(56) References Cited

U.S. PATENT DOCUMENTS 4,507,584 A * 3/1985 Coaton et al. ..... 313/624

* cited by examiner

*Primary Examiner*—Joseph Williams
(74) *Attorney, Agent, or Firm*—William E. Meyer

(57) ABSTRACT

A method of producing a ceramic metal halide discharge lamp having a monolithic seal between a sapphire (single crystal alumina) arc tube and a polycrystalline alumina (PCA) end cap. The method includes the steps of providing an arc tube of fully dense sapphire and providing an end cap made of unsintered compressed polycrystalline alumina powder doped with magnesium oxide and yttrium oxide. The end cap is heated until it is presintered to remove organic binder material at a low temperature relative to the sintering temperature. The presintered end cap is placed on an end portion of the arc tube to form a close interface between the two. The presintered end cap and adjacent arc tube are then heated to until the end cap is fully sintered onto the arc tube and the sapphire tube grows into the end cap. A monolithic seal is formed along the interface between the end cap and the arc tube as the sapphire tube grows into the polycrystalline alumina end cap. The yttrium oxide promotes increased growth between sapphire tube and the PCA end cap and is not detrimental to the metal halide chemistry, nor subject to erosion by the metal halide chemistry.

8 Claims, 4 Drawing Sheets

MONOLITHIC SEAL FOR A SAPPHIRE METAL HALIDE LAMP

Basic aspect(s) of this invention is/are disclosed in copending application entitled having Ser. No. 09/952,982 now issued as U.S. Pat. No. 6,873,108 as filed by the present Applicant on Sep. 14, 2001, and the benefit of the filing date of that Application is hereby claimed for this Divisional Application.

TECHNICAL FIELD

The invention relates to electric lamps and particularly to ceramic metal halide lamps. More particularly the invention is concerned with a monolithic seal for a sapphire metal halide lamp.

BACKGROUND ART

Polycrystalline alumina (PCA) lamp envelopes allow higher operating temperature than conventional quartz envelopes, providing better lamp performance including improved color rendering, color spread, and higher efficacy, particularly with metal halide fills. A known improvement is to use a sapphire (unitary crystalline alumina) tube sealed with a PCA end cap. Sapphire cannot be melted and pressed like glass or quartz, rather an end cap or plug is formed to press against the rigid sapphire. Too little pressure leads to leakage. Too much pressure leads to fracture of the crystalline sapphire. An art has then developed regarding the sealing of sapphire tubes. None the less, sealing a relatively large sapphire tube, for example one with a 3 to 4 millimeter ID and a 0.7 millimeter thickness or more, remains a difficult operation due to the expansion anisotropy and the tendency of sapphire to cleave and crack along low-angle grain boundaries. There is then a need for an improved method of joining PCA end caps assemblies to sapphire arc tubes. The present invention deals generally with a method of sealing sapphire tubes, including those that are relatively large, for example those typically used in 100 Watt HCI lamps.

U.S. Pat. No. 5,424,609 discloses PCA arc tubes comprising 5 piece structures including a cylindrical body, a pair of end enclosures, and a pair of electrode receiving rods or end capillary PCA tubes sealed to the buttons. Three piece assemblies have been disclosed in European patent application EP 0827177 A2 where an integrally molded body composed of an electrode member-inserting portion and an annular portion located around the electrode-member inserting portion are inserted as an integrally formed body into a molded cylindrical tubular body, and sintering of the entire assembly into a final body. U.S. Pat. No. 6,004,503 shows two piece structures including forming as in integral unit a hollow body having an open end and a substantially closed end. The substantially closed end has an outwardly extending end capillary PCA tube having an electrode receiving aperture. The integral unit combines with an end cap consisting of an annular portion and an extending end capillary sapphire tube to form an assembly for sintering into the final body. Similar structures are disclosed in EP 0954010 A1. Moreover, a bulgy shaped arc tube consisting of a cylindrical central part and two hemispherical end pieces with improved isothermy is disclosed in U.S. Pat. No. 5,936,351.

Sapphire has been used for envelopes in high pressure sodium (HPS) lamps. U.S. Pat. No. 4,423,353 reports an electroded, sapphire lamp containing high-pressure sodium. The sealing method uses frits that are strategically located away from the ends of the sapphire tubes, where critical flaws reside. The flaws may propagate resulting in catastrophic cracking if the thermal stresses exceed the strength of sapphire during sealing.

Sealing of sapphire tubing can be accomplished by an edge defined film fed growth technique. This is a variation of the technique used for production of single-crystal sapphire tubing. This method is most applicable to the formation of the first seal, but is undesirable for the second seal due to the high temperature (2050° C.) required for sapphire melting.

A novel direct seal technique for PCA tubes disclosed in U.S. Pat. No. 4,427,924 involves no frits. It uses prefired a PCA end cap doped with 2.0 weight percent $Y_2O_3$ and containing a niobium electrode mounted on the open end of the fully sintered PCA end cap. A final firing causes the end cap to shrink to form a fritless seal with the PCA tube. U.S. Pat. No. 4,427,924 involves a liquid phase sintering mechanism through the use of a 2 weight percent $Y_2O_3$ doped PCA end cap and a PCA tube.

U.S. Pat. No. 5,621,275 discloses a sapphire arc tube closed with a PCA end cap through an interference fit (sintered shrinkage) of the PCA end cap against the sapphire tube, for an electrodeless arc discharge lamp. PCA arc tubes closed with PCA end caps through the direct joining are also disclosed in the same patent.

International patent application WO 99/41761 discloses a monolithic seal for sapphire ceramic metal halide lamp. The monolithic seal uses the PCA end cap approach of U.S. Pat. No. 5,621,275, except that electrode feedthroughs are frit-sealed to end capillaries.

SUMMARY OF THE INVENTION

The present invention provides a method of making a ceramic arc tube lamp assembly for a ceramic metal halide discharge lamp. The method includes the steps of providing a tube made of sapphire (single crystal alumina) and providing an end cap made of unsintered polycrystalline alumina (PCA) doped with magnesium oxide (MgO) and yttrium oxide ($Y_2O_3$). The PCA end cap is heated until it is presintered to drive off the binder material. The presintered end cap is then fitted on the sapphire tube to form an interface. The presintered and doped PCA end cap and the sapphire tube are then heated until the doped PCA end cap is sintered onto the sapphire tube and the sapphire crystal of the sapphire tube grows into the doped PCA end cap to form a monolithic seal at the previous interface between the PCA end cap and the sapphire tube.

DETAILED DESCRIPTION OF PREFERRED EMBODIMENTS

Figure 1:
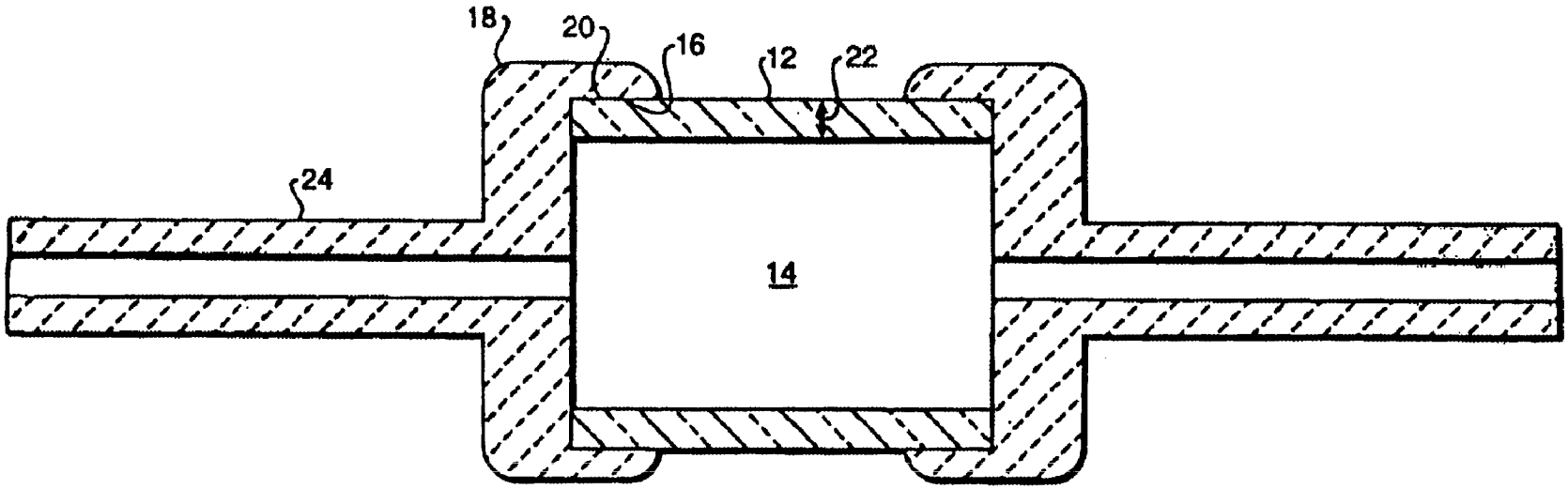
FIG. 1 is a cross-sectional schematic view of a lamp assembly having a sapphire arc tube and a ceramic end cap after presintering but prior to sealing according to the present invention.

FIG. 1 is a cross-sectional schematic view of a lamp assembly having a sapphire arc tube 12 and a ceramic end cap 18 after presintering but prior to sintering and sealing according to the present invention. There are numerous ways of forming the end caps as is known in the art. For example, several may be seen in U.S. Pat. No. 6,274,982 which is hereby incorporated by reference. The end cap may include an interior groove to mate with the generally annular end of the sapphire tube or not. The end cap may include an end capillary to support or seal with an electrode or not. Such structural variations of the end cap are considered to be equivalent variations of the basic end cap considered here. Both lamp ends may be similarly or even identically formed. It is only relevant that at least one end of the sapphire tube be sintered and sealed according to the present structure.

The lamp seal initially comprises a sapphire (single crystal alumina) tube 12 defining an enclosed interior volume 14, and including an exterior end surface 16. The preferred sapphire arc tube 12 is tubularly shaped having annularly shaped end surfaces and generally cylindrically shaped outer and inner surfaces. The wall thickness 22 can be of any suitable size. The transparent arc tube 12 is formed from fully dense sapphire. The sapphire tube may be produced in any suitable manner. Sapphire tubes with a C-axis parallel to the lengths of the tubes were used. The sapphire tube 12 is closed by a polycrystalline alumina (PCA) end cap 18 having an interior surface 20 adjacent the exterior surface 16.

The end caps 18 are formed from a polycrystalline alumina (PCA) doped with magnesium oxide and yttrium oxide. The PCA may be doped with from 150 to 1000 ppm of MgO, and from 100 to 700 ppm $Y_2O_3$. The preferred doping is 500 ppm MgO and 350 ppm $Y_2O_3$. The following procedure was used to fabricate the PCA end cap and end capillary assembly. Alumina powder (CR6, Baikowski) was doped by spray drying with 500 ppm of magnesium oxide (MgO) and 350 ppm of yttrium oxide ($Y_2O_3$) as sintering aids. The doped PCA was shaped into end caps that could be fitted to sapphire arc tubes. End caps 18 were initially made with only MgO (500 ppm) as the dopant. The joints between the PCA end cap and the sapphire tube in these lamps were not reliably hermetic. A higher surface area powder (CR30, Baikowski) was then tried. Still, the joint was not hermetic in helium leak tests. The $Y_2O_3$ dopant was then added to the PCA to form a liquid phase between the PCA end cap 18 and the sapphire tube 12 during sintering. The liquid phase was found to help conform the end cap shape more completely to the somewhat faceted surface of the as-grown sapphire tube. The PCA, MgO and $Y_2O_3$ combination then resulted in a helium leak-tight seal between the PCA and sapphire tube.

To form the PCA end caps, the MgO and $Y_2O_3$ doped alumina powder with an organic binder was isostatically pressed into logs at 12.5 kpsi. The logs were fired in air to 1200° C. to remove the organic binder. The presintered logs were then machined to their final shape, which was sized to form a 6.0 percent interference seal with the sapphire tube after sintering (1.0 percent to 7.0 percent is believed to be a functional range). In other words, sintering the end cap alone would normally have resulted in an inside diameter 6.0 percent smaller than the outside diameter of the sapphire tube. The resulting interference fit of approximately 6.0 percent in the combined assembly was sufficient to form good mechanical contact between the doped PCA end caps and the sapphire tube during subsequent sintering thereby assisting growth of the sapphire into the PCA during sintering.

The end capillary PCA tubes 24 were made by extrusion of alumina powder (CR6, Baikowski, doped with 500 ppm MgO). The extruded PCA capillary tubes 24 were then cut to length, and inserted into the machined PCA end caps 18. The PCA end cap and PCA end capillary assembly was then fired at 1325° C. in air to lock the two pieces together.

The end cap 18 and end capillary 24 assemblies were then locked onto the two ends of the sapphire tube 12 by firing vertically at 1350° C. in air. The arc tube assemblies were positioned vertically to maintain the straight alignment of the PCA end cap and end capillary assembly. The assembled sapphire arc tubes with end caps were sintered in flowing wet hydrogen (dew point equal to 0° C.) at 1880° C. for four hours at a heating rate of 15° C. per minute. The heating cycle had a hold at 1400° C. for 30 minutes. Moisture was introduced with the hydrogen at the beginning of this 1400° C. hold period. Sintering was conducted in a cold-wall, molybdenum shielded, tungsten element furnace. A charge of 3 grams of alumina oxide doped with 10.0 percent MgO was used in the furnace chamber to create magnesium vapor species during sintering to thereby avoid exaggerated grain growth in the PCA due to excessive loss of the MgO dopant in the PCA during sintering. Cooling occurred at a rate of 30° C. per minute. The average grain size in the final sintered PCA body was in the range of 20 to 30 micrometers, which was desired for high light transmittance concurrent with high mechanical strength.

Figure 2:
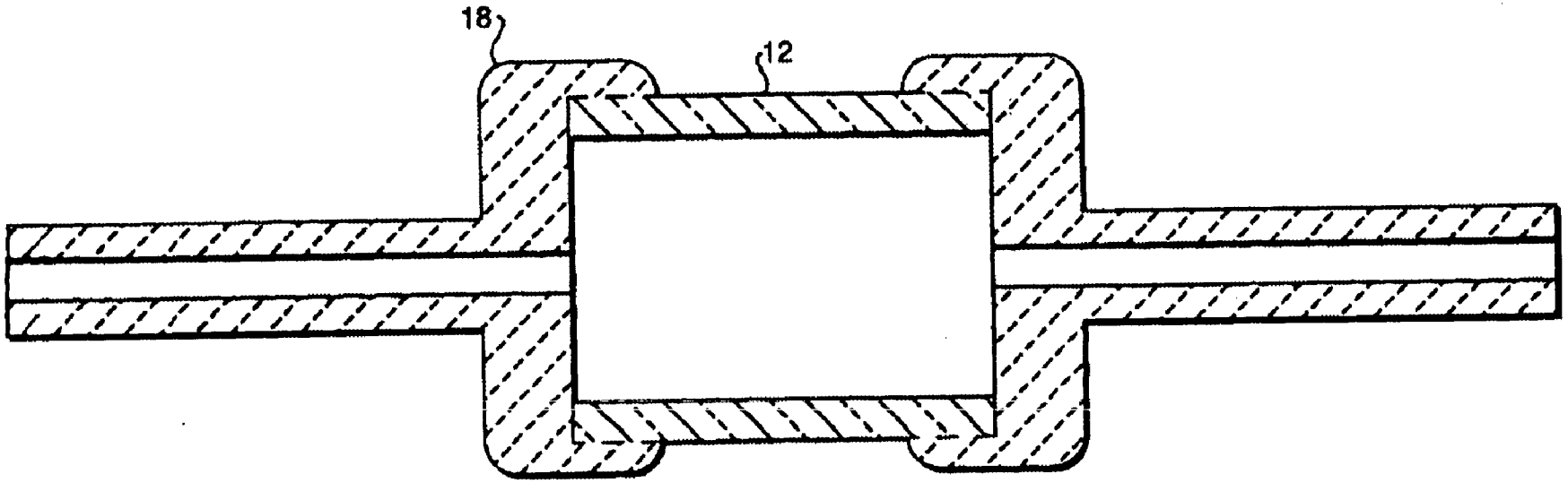
FIG. 2 is a cross-sectional schematic view of a lamp assembly having a sapphire arc tube and a ceramic end cap after sintering according to the present invention.

FIG. 2 is a cross-sectional schematic view of a lamp assembly having a sapphire arc tube 12 and a ceramic end cap 18 after sintering according to the present invention. After sintering the sapphire material of the exterior surface 16 merges with the doped PCA material of the interior surface 20 to form a monolithic seal between the sapphire tube 12 and the PCA end cap 18. The merged material region then extends around the sapphire tube 12 to provide a hermetic, monolithic seal between the sapphire tube 12 and the PCA end cap 18. The MgO dopant may reside in the final PCA in three ways 1) dissolved in the atomic lattice, 2) segregated in the grain boundaries and 3) as a formation of MgO—$Al_2O_3$ spinel second phase. Similarly the $Y_2O_3$ may reside in the PCA in three ways 1) dissolved in the atomic lattice, 2) segregated in the grain boundaries and 3) as a formation of $3Y_2O_3$—$5Al_2O_3$, (YAG) second phase. Reference to a completed lamp with PCA doped with $Y_2O_3$ shall then mean PCA with $Y_2O_3$ in one or more of these resulting forms.

The formation of the sapphire to PCA bond is significantly facilitated by the liquid phase, which is present due to the PCA dopants. The MgO may range from 100 to 1000 ppm. The $Y_2O_3$ may range from 100 to 700 ppm. The preferred values are 500 ppm of MgO and 350 ppm of $Y_2O_3$. In PCA doped with 500 ppm MgO plus 350 ppm $Y_2O_3$, a liquid phase in the $Al_2O_3$—$Y_2O_3$-MgO system forms at temperatures above 1761° C. The liquid phase promotes a bimodal grain size distribution in the PCA. In contrast, PCA doped solely with MgO reaches full densification by a solid state diffusion mechanism and has a uniaxed grain size distribution. The liquid phase facilitates the sapphire to PCA direct bond formation in several ways. It exerts a capillary force to draw the PCA closer to the sapphire. The liquid phase material also fills in gaps or voids (if any) at the initial sapphire to PCA interface. The liquid phase also allows a high degree re-arrangement in the PCA grains, which enhances the bond between sapphire and PCA.

During the formation of the direct bond, the initial sapphire to PCA boundary migrates towards the PCA. The migration of the boundary is basically the result of growth of sapphire into the PCA. The driving force for the migration is believed to be boundary energy, while the kinetics of the boundary growth is related to boundary diffusion. The depth of the migration of the sapphire to PCA boundary into PCA has generally been found to be higher for PCA doped with MgO and $Y_2O_3$, than for PCA doped with only MgO.

Figure 3:
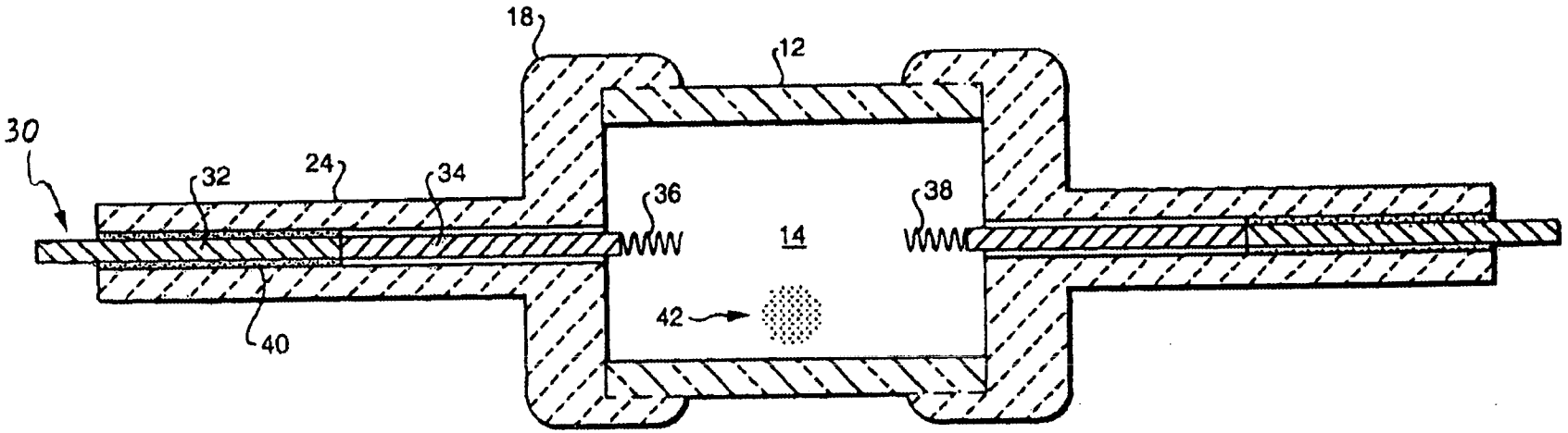
FIG. 3 is a cross-sectional schematic view of a lamp assembly having a sapphire arc tube and a ceramic end cap after filling and sealing according to the present invention.

FIG. 3 is a cross-sectional schematic view of a lamp assembly having a sapphire arc tube 12 and a ceramic end cap 18 after sealing with electrode assemblies 30 according to the present invention. The electrode assembly 30 may be made according to any number of formats. The preferred electrode assembly 30 includes a straight support having a niobium outer end 32 coupled to a molybdenum inner end 34 that supports a tungsten tip 36 or coil 38. The support and the tip or coil are slid through the capillary 24 until properly positioned. The gap between the capillary tube 24 and the niobium outer end 32 is filled and sealed with a frit 40. The interior volume 14 of the capsule includes a fill 42 comprising any of numerous known metal halide salts and an inert fill gas, such as argon, krypton or xenon. The preferred lamp fill consisted of 11.5 milligrams of mercury and 14 milligrams of metal halide salts. The buffer gas used in the 100 watt sapphire lamps was 150 mbar of argon. The size of sapphire tubes used for the 100 watt lamps was: 8.4 millimeters OD by 6.8 millimeters ID by 10 millimeters long. Arc tubes with sapphire tubes as small as: 3.1 millimeters OD×1.5 millimeters ID×8 millimeters long were also tested using injection-molded PCA end caps of similar shape to the 100 watt lamp. The 100 watt lamp had a preferred arc gap of 5.0 millimeters. 100 watt lamps made according to this method were run on a 60 Hz H-bridge ballast, supplying square wave input power. Both electrodes then went through both anode and cathode cycles. Two lamps were aged for one hour. The electrode temperatures in the tip region reached values of 3200° K at the bottom electrode, and around 3400° K at the top electrode. Lamp data was then measured. The lumens per watt (LPW) was about 85, the color rendering index (CRI) was about 90 and the redness measure (R9) was about 25. Color corrected temperature (CCT) was 3100° K.

Figure 4:
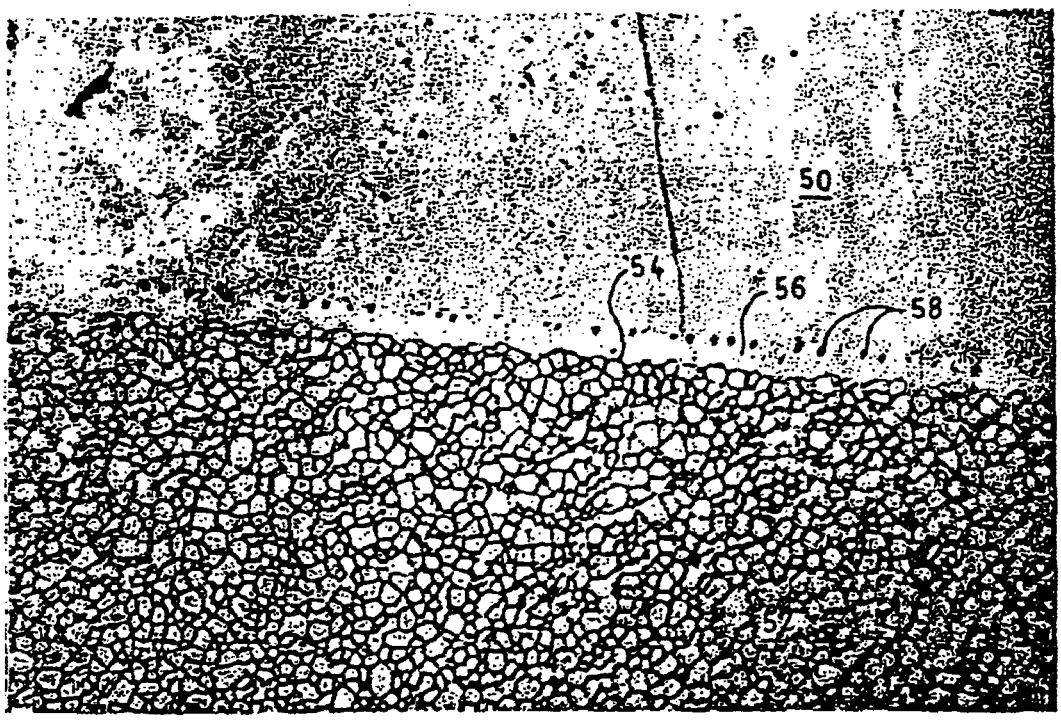
FIG. 4 (PRIOR ART)
FIG. 4 is a photographic view of a cross section of a sapphire and PCA interface of a prior art lamp seal, using only MgO doped PCA (prior art)

FIG. 4 is a photographic view of a cross section of a sapphire and PCA interface of a prior art lamp seal, using only MgO doped PCA. In the prior art seal the sapphire material 50 is seen as nearly featureless, while the PCA material 52 is seen as a vast number of closely packed polygonal particles with an average diameter of approximately 8.0 microns. The interfaces between the sapphire material 50 and the PCA material 52 is a nearly straight line varying along the PCA interface line 54 by perhaps less than one fifth of the average PCA grain diameter. It is easy to see that separation could propagate along this interface line 54. Adjacent the PCA material 52, on the sapphire 50 side is a narrow band of interface material 56. A line of residual interstitial holes 58 defines the width of this band of interface material 56. The interface material 56 is crystalline growth from the sapphire material 50 into the PCA material 52. It can be seen by the measurement marker that the width of this sapphire growth is approximately 20 microns. FIG. 4 then shows the limited growth of sapphire (interface material 56) into MgO doped PCA.

Figure 5:
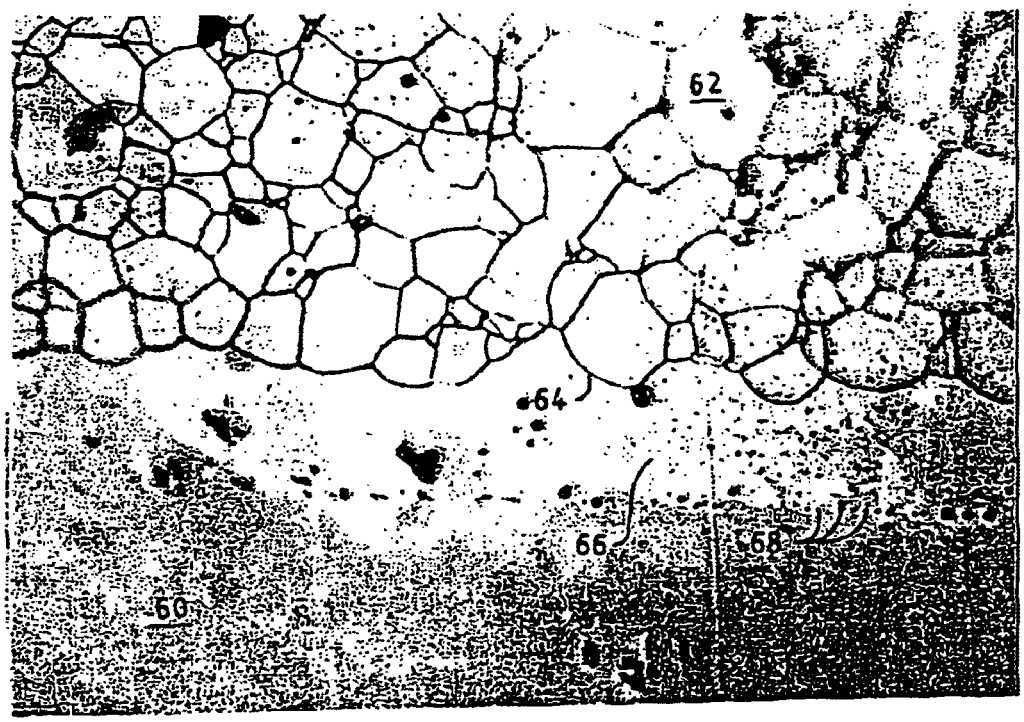
FIG. 5 is a photographic view of a cross section of a sapphire and PCA interface of a lamp seal, using magnesium oxide and yttrium oxide doped PCA.

FIG. 5 is a photographic view of a cross section of a sapphire and PCA interface of a lamp seal, using MgO and yttrium oxide doped PCA. In the seal, the sapphire material 60 is again seen as nearly featureless, while the PCA material 62 is again seen as a large number of closely packed polygonal particles with an average diameter of about 25.0 microns. The interface line 64 between the sapphire material 60 and the PCA material 62 is irregular, with straight portions in part, but also ragged or rough portions. The dimensional variation along the PCA interface line 64 is about one half or even one times the average PCA grain diameter which grains are also substantially larger. It is easy to see that separation along this interface line 64 is less likely than in the prior art example. Adjacent the PCA material 62, on the sapphire 60 side is a narrow band of interface material 66. A line of residual interstitial holes 68 defines the width of this band of interface material 66. The interface material 66 is crystalline growth from the sapphire material 60 into the PCA material 62. It can be seen by the measurement marker that the width of the sapphire growth is approximately 120 microns, nearly six times as great as in the prior art sample. These measurements can be made by use of known metallographic etching and photography methods. FIG. 5 then shows the increased growth of sapphire into the MgO and $Y_2O_3$ doped PCA.

The increased sapphire growth is believed to be related to a solutional reprecipitation process brought about by the liquid phase. Moreover, the advancing sapphire to PCA interface is rougher when the PCA doped with MgO and $Y_2O_3$, as compared to the relatively straight interface when the PCA is doped with only MgO. A comparison of the interface roughness can be made by measuring the maximal peak to valley distance along the interface. The interface roughness for the sapphire—PCA doped with MgO and $Y_2O_3$ was about 40 microns, while the interface roughness for the sapphire—PCA doped with just MgO was only about 2 or 3 microns. In short the addition of yttrium oxide as a PCA dopant 1) increases the depth of the growth zone and 2) locks the two faces together with a more jagged interface.

It was has been believed that since $Y_2O_3$ has a poor compatibility with rare earth metal halide lamp fills, it could not be used in ceramic metal halide lamps. Yttrium oxide was expected to adversely react with the metal halide materials, resulting in deterioration of the interior lamp chemistry and the lamp seals. The Applicants' have however discovered that there was no compatibility problem with sapphire sealed to PCA doped with MgO and $Y_2O_3$. The metal halide lamps constructed by this method showed no noticeable chemical deterioration of the lamp fill, and showed no noticeable chemical interaction between the fill material and the envelope material. This is believed to be the result in part of (1) the $Y_2O_3$ dopant becoming a YAG (yttrium aluminate garnet, $3Y_2O_3$— $5Al_2O_3$ phase in the PCA, and (2) this YAG phase is held in the form of discrete particles that are buried in the alumina microstructure, and therefore have little or no direct exposure to the metal halide lamp fills.

Although a particular embodiment of the invention has been described in detail, it will be understood that the invention is not limited correspondingly in scope, but includes all changes and modifications coming within the spirit and terms of the claims appended hereto.

What is claimed is:

1. A method of making a seal for a high pressure discharge lamp comprising the steps of:

providing a tube made of sapphire with an exterior surface;

providing in a presintered state, an end cap made of unsintered doped polycrystalline alumina, the end cap shaped to have an interior surface substantially conformal with the exterior wall, placing the presintered end cap adjacent the sapphire tube, heating the sapphire tube and end cap to sinter the end cap, to shrink the end cap into tight coupling with the sapphire tube, and to induce a liquid phase in the end cap at least adjacent the sapphire tube;

holding the sapphire tube and end cap in a heated state sufficiently long to induce growth of the sapphire tube into the end cap; and cooling the sapphire tube and end cap to preserve the crystalline growth from the sapphire tube into the end cap.

2. The method of making a seal in claim 1, wherein the PCA is doped with magnesium oxide and yttrium oxide.

3. The method of making a seal in claim 2, wherein the magnesium oxide doping has a weight percent value of between 0.0150 percent and 0.1000 percent.

4. The method of making a seal in claim 2, wherein the yttrium oxide doping has a weight percent value of between 0.0100 percent and 0.0700 percent.

5. A method of forming a ceramic lamp envelope with a sapphire tube comprising the steps of:

a) providing a substantially round sapphire tube defining an interior volume, and having an outside diameter A greater than 2.0 millimeters;

b) providing an end cap comprising a partially densified polycrystalline alumina doped with a material to induce substantially complete densification of the end cap during sintering and providing a liquid phase in a portion of the end cap material during densification, the end cap having a substantially round interior recess with an inside diameter B greater than the sapphire tube diameter A, which if the end cap were fully densified independently of the sapphire tube by sintering would have an internal diameter after sintering from 93 percent to 99 percent of the sapphire tube diameter A;

c) positioning an end of the sapphire tube in the end cap; and d) sintering the sapphire tube and end cap at a sufficiently high temperature for a sufficiently long period to induce shrinkage of the end cap interior wall against the sapphire tube exterior wall while exhibiting a liquid phase in portions of the end cap material to thereby mechanically conform to the end cap interior wall to the sapphire tube exterior and induce grain growth between the sapphire tube and the end cap to provide a hermetic seal.

6. The method of making a seal in claim 5, wherein the end cap composition includes magnesium oxide and yttrium oxide dopants.

7. The method of making a seal in claim 6, wherein the magnesium oxide doping has a weight percent value of between 0.0150 percent and 0.1000 percent.

8. The method of making a seal in claim 6, wherein the yttrium oxide doping has a weight percent value of between 0.0100 percent and 0.0700 percent.

* * * * *